United States Patent [19]

Iwayama et al.

[11] 4,268,326

[45] May 19, 1981

[54] PROCESS FOR PRODUCING GRAIN ORIENTED ELECTRICAL SILICON STEEL SHEET

[75] Inventors: Kenzo Iwayama, Kitakyushu; Osamu Tanaka, Nougata, both of Japan

[73] Assignee: Nippon Steel Corporation, Tokyo, Japan

[21] Appl. No.: 47,801

[22] Filed: Jun. 11, 1979

[30] Foreign Application Priority Data

Jun. 9, 1978 [JP] Japan ..... 53-69416

[51] Int. Cl.[3] ..... H01F 1/04

[52] U.S. Cl. ..... 148/113; 148/111; 148/12A; 148/12.1; 148/16

[58] Field of Search ..... 148/112,113, 16, 111, 148/12.1, 12 A

[56] References Cited

U.S. PATENT DOCUMENTS

| | | | |
|---|---|---|---|
| 3,259,526 | 7/1966 | Walker et al. | 148/113 |
| 3,287,184 | 11/1966 | Koh | 148/113 |
| 4,046,602 | 9/1977 | Stanley | 148/112 |
| 4,123,298 | 10/1978 | Kohler | 148/113 |

*Primary Examiner*—L. Dewayne Rutledge
*Assistant Examiner*—John P. Sheehan
*Attorney, Agent, or Firm*—Wenderoth, Lind & Ponack

[57] ABSTRACT

An electrical silicon steel sheet composed of secondary or tertiary recrystallized grains oriented in one or two directions, is produced by a process comprising a decarburization annealing operation in an oxidation atmosphere in which a ratio of $PH_2O/PH_2$ wherein $PH_2O$ represents a partial pressure of water vapor in said oxidation atmosphere and $PH_2$ represents a partial pressure of hydrogen in said oxidation atmosphere, is adjusted to a value of 0.15 or more in an initial stage of said decarburization annealing operation and, then, to a value smaller than that in said initial stage in a final stage of said decarburization annealing operation.

6 Claims, 8 Drawing Figures

$$\frac{P_{H_2O}}{P_{H_2}} \geq 0.15 \quad \frac{P_{H_2O}}{P_{H_2}} > \frac{P'_{H_2O}}{P'_{H_2}}$$

$$P_{H_2O}/P_{H_2} = 0.15 \sim 0.75$$

$$P_{H_2O}/P_{H_2} \geq 0.15 \quad \Big| \quad P_{H_2O}/P_{H_2} > P'_{H_2O}/P'_{H_2}$$

PROCESS FOR PRODUCING GRAIN ORIENTED ELECTRICAL SILICON STEEL SHEET

The present invention relates to a process for producing a grain oriented electrical silicon steel sheet. More particularly, the present invention relates to a process for producing an electrical silicon steel sheet which is composed of secondary or tertiary recrystallized grains oriented in one direction or in two directions, which process comprises a decarburization annealing operation.

The grain oriented electrical silicon steel sheet having an excellent magnetic property in a special direction, is usable as a material for producing steel cores of potential transformers or large size of generators. The grain oriented electrical silicon steel sheet is produced in such a process that: a silicon steel containing predetermined indispensable components is converted into a strip by using an ingot method or a continuous casting method; the silicon steel strip is hot rolled at an elevated temperature; the hot rolled silicon steel strip is, if necessary, annealed, and acid pickled, and; then, the steel strip is cold rolled once or twice. If it is necessary, an intermediate annealing operation may be applied to the silicon steel strip in a stage between the above-mentioned two cold rolling operations. In the cold rolling operation, the direction of the rolling may be altered during the rolling operation, for example, by way of a so-called cross-rolling method, in order to obtain a bi-directional grain oriented silicon steel sheet. Thereafter, the cold rolled silicon steel sheet is subjected to a decarburization annealing operation in a wet mixed gas atmosphere comprising a major part of hydrogen, or a mixture of hydrogen and nitrogen, and a minor part of oxygen. The silicon steel sheet is coated with an annealing separator such as magnesium oxide (MgO) and, then, subjected to a finishing annealing operation. During the above-mentioned process, the grain oriented silicon steel sheet can obtain an excellent magnetic property in a special direction of the sheet, by forming a primary recrystallized grain matrix in the decarburization annealing operation and by growing primary recrystallized grains oriented in a special direction in the matrix, by way of a secondary recrystallization or a tertiary recrystallization in the finishing annealing operation. The finishing annealing operation in which the decarburized sheet is coated with an annealing separator, such as magnesium oxide (MgO), causes a glass film to be formed on the surface of the sheet. When the sheet is converted into a plurality of steel cores and the cores are superimposed on each other, the capability of the superimposed cores of withstanding high voltage depends on the property of the glass film formed on the sheet.

Accordingly, in the production of the grain oriented electrical silicon steel sheet, it is important to constantly produce a sheet having not only a desired magnetic property but, also, a high capability of forming the glass film having a desired property, with a high productivity.

Generally, in the production of the electrical silicon steel sheet, the value of watt loss decreases with a decrease in the thickness of the sheet. This phenomenon is also true in the production of the grain oriented electrical silicon steel sheet. Generally, most of the usual grain oriented electrical silicon steel sheets have a thickness of 0.35 mm, 0.30 mm or 0.275 mm. In conventional processes, it is difficult to produce a grain oriented steel sheet having a thickness less than 0.275 mm, because the smaller the thickness of the sheet, the more difficult the growth of the secondary recrystallized grains becomes.

In a conventional process for producing the grain oriented electrical silicon steel sheet, the starting silicon steel contains a relatively large amount of from 0.02 to 0.07% by weight of carbon, because the carbon in the steel is an important element for controlling the metallographical structure of the resultant steel product. However, a large content of carbon in the steel product causes the magnetic property of the steel product to be remarkably poor. Accordingly, usually, the content of carbon in the steel product is reduced to a level of about 0.0030% or less by way of a decarburization annealing operation, before the finishing annealing operation. During the decarburization annealing operation, the carbon is diffused into the outer surface of the steel product, and there reacts with oxygen in the ambient atmosphere so that the carbon is converted into carbon monoxide and removed from the steel product. However, in the case where the content of oxygen in the ambient atmosphere is excessively large, the oxygen reacts not only with the carbon but, also, with silicon, iron and other elements in the steel product, which overoxidizes the surface of the steel product. Sometimes, the overoxidization may result in formation of a oxide film on the steel product. This oxide film causes the rate of the decarburization of the steel product to be reduced. That is, the rate of decarburization is regulated by a so-called interfacial rate control. Therefore, it is important to control the content of oxygen in the annealing atmosphere. Usually, the content of oxygen is controlled by feeding hydrogen gas or a mixture of hydrogen and nitrogen gases which has been passed through water at a predetermined temperature, so as to feed water vapor into the decarburization annealing atmosphere and adjust the dew point of the atmosphere. The dew point which is closely related to the content of oxygen in the atmosphere, is variable with the content of hydrogen gas in the atmosphere. Therefore, the content of oxygen in the decarburization annealing atmosphere can be represented by a ratio of $PH_2O/PH_2$, wherein $PH_2O$ represents a partial pressure of water vapor and $PH_2$ represents a partial pressure of hydrogen in the atmosphere.

In the conventional process, the ratio of $PH_2O/PH_2$ is maintained constant throughout the entire period of the decarburization annealing operation. That is, usually, the ratio of $PH_2O/PH_2$ of the oxidation atmosphere is adjusted to a fixed value of from about 0.15 to 0.75. When the fixed ratio of $PH_2O/PH_2$ is smaller than 0.15, the period of the decarburization annealing operation will be undesirably prolonged, due to the small content of oxygen in the decarburization annealing atmosphere. Also, when the fixed ratio of $PH_2/PH_2$ is larger than 0.75, the surface of the steel sheet will be excessively oxidized, and the rate of decarburization will be regulated by the so-called interfacial rate control.

Usually, the conventional decarburization annealing operation in which the ratio of $PH_2O/PH_2$ is maintained at a constant value throughout the entire period of the operation, results in a relatively poor magnetic property and capability of forming an excellent glass film, of the resultant electrical steel sheet. Also, the conventional decarburization annealing operation causes the quality of the resultant electrical steel sheet to be uneven and the productivity of the electrical steel sheet to be poor. Furthermore, it has been found that the conventional decarburization annealing operation is not effective for growing the secondary crystallized grains when the sheet has a thickness of 0.225 mm or less.

An object of the present invention is to provide a process for producing a grain oriented electrical silicon steel sheet having not only an excellent magnetic property but, aslo, a high capability of forming an excellent glass film thereon.

Another object of the present invention is to provide a process for constantly producing a grain oriented electrical silicon steel sheet having a uniform quality with a high productivity.

Still another object of the present invention is to provide a process for producing a grain oriented electrical silicon steel sheet, which process is capable of stably growing secondary recrystallized grains in the sheet, even if the sheet is very thin, for example, a thickness of 0.225 mm or less, which thickness results in it being difficult to grow the secondary crystallized grains in the conventional decarburization annealing operation.

The objects can be attained by the present invention, which relates to a process for producing a grain oriented electrical silicon steel sheet by decarburization annealing a grain oriented steel sheet in an oxidation atmosphere, and which is characterized in that a ratio of $PH_2O/PH_2$, wherein $PH_2O$ represents a partial pressure of water vapor in said oxidation atmosphere and $PH_2$ represents a partial pressure of hydrogen in said oxidation atmosphere, is adjusted to a value of 0.15 or more in an initial stage of the decarburization annealing operation and, then, to a value smaller than that in the initial stage, in a final stage of the decarburization annealing operation.

The features and advantages of the present invention will be exemplified and more fully explained in the description presented below with reference to the accompanying drawings, in which.

In the decarburization annealing operation of the process of the present invention, it is important that the ratio of $PH_2O/PH_2$ in the oxidation atmosphere in the initial stage of the operation be adjusted to a value of 0.15 or more and, then, that the ratio of $PH_2O/PH_2$ in the final stage of the operation be adjusted to a value smaller than that in the initial stage. It is preferable that the ratio of $PH_2O/PH_2$ in the final stage of the decarburization annealing operation be maintained at a value of 0.75 or less and smaller than that in the initial stage.

Also, it is preferable that the final stage of the decarburization annealing operation is carried out at a temperature of from 750° to 1200° C., more preferably, from 750° to 880° C. Furthermore, it is preferable that the proportion of the period of the final stage of the decarburization annealing operation to the entire period of the decarburization annealing operation is in a range of from 1/10 to 9/10, more preferably, from 1/5 to 3/5.

Figures 1, 2, 3:
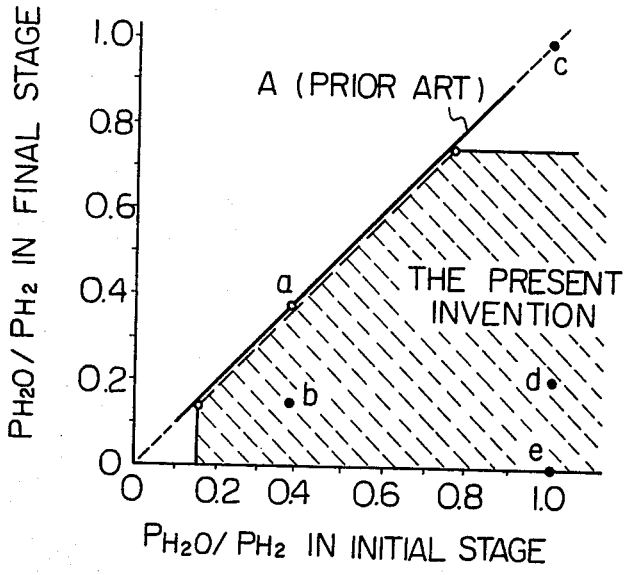
Fig. 1 PRIOR ART
FIG. 1 is an explanatory diagram of a conventional decarburization annealing operation.
FIG. 2 is an explanatory diagram of the decarburization annealing operation in accordance with the process of the present invention.
FIG. 3 is an explanatory diagram showing relationship between the ratio of $PH_2O/PH_2$ in the initial stages and the ratio of $PH_2O/PH_2$ in the final stages of the decarburization annealing operations in a conventional process and the process of the present invention.

In a conventional decarburization annealing operation represented graphically in FIG. 1, the ratio $PH_2O/PH_2$ of the oxidation atmosphere is maintained at a constant value of from 0.15 to 0.75 throughout the entire period of the operation.

In the decarburization annealing operation in the process of the present invention represented graphically in FIG. 2, the ratio of $PH_2$ of the oxidation atmosphere is maintained, in the initial stage of the operation, at a value of 0.15 or more and, then, changed in the final stage of the operation to a value smaller than that in the initial stage and preferably, of 0.75 or less.

FIG. 3 shows a relationship between the ratios of $PH_2O/PH_2$ in the initial stage and the final stage of the decarburization annealing operations in the processes of the prior art and the present invention. In the prior art, the value of $PH_2O/PH_2$ in the initial stage is the same as that in the final stage. Therefore, all the relationships between the ratios of $PH_2O/PH_2$ in the initial and final stages in the prior art are contained in a straight line A at an angle of 45 degrees from the axis of abscissa of FIG. 3. However, in the process of the present invention, all the relationships are contained in an area marked by slanted lines in FIG. 3. The slanted line area is located below the straight line A in FIG. 3.

In the decarburization annealing operation of the process of the present invention, the value of the ratio of $PH_2O/PH_2$ in the initial stage of the operation must be 0.15 or more. If the value of the ratio of $PH_2O/PH_2$ in the initial stage is smaller than 0.15, the period of time necessary for completing the decarburization of the steel sheet will be undesirably prolonged. The larger the ratio of $PH_2O/PH_2$ in the initial stage, the shorter the initial stage of the operation.

Figure 4:
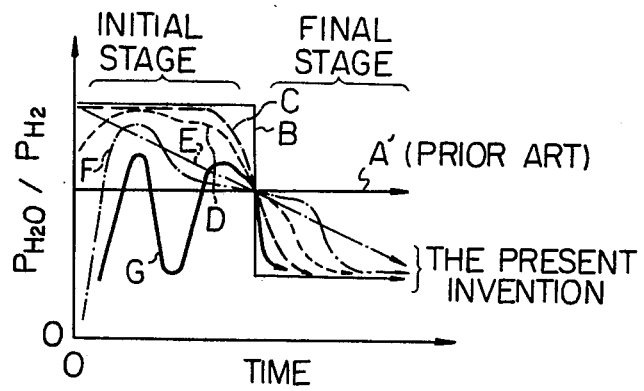
FIG. 4 is an explanatory diagram showing several examples of change in the ratio of $PH_2O/PH_2$ with the lapse of time of the decarburization annealing operation in the process of the present invention.

FIG. 4 illustrates how to control the ratio of $PH_2O/PH_2$ during the decarburization annealing operations in the prior art and the process of the present invention. Referring to FIG. 3, a straight line A shows that a fixed value of the ratio of $PH_2O/PH_2$ is maintained over the entire period of the decarburization annealing operation in the prior art. Curves B, C, D, E F and E each shows that the ratio of $PH_2O/PH_2$ in the initial stage is controlled at a high level and, the level of the ratio of $PH_2O/PH_2$ in the final stage is lower than that in the initial stage. In the case of Curve B, the ratio of $PH_2O/PH_2$ is maintained at a fixed value, in the initial stage, is very rapidly changed to a low level of value between the initial and final stages and, then, is maintained at the fixed low level of the value in the final stage.

In the case of Curve C, the value of the ratio of $PH_2O/PH_2$ is controlled in the same manner as that in Curve B, except that the value of the ratio of $PH_2O/PH_2$ is gradually lowered in a later part of the initial stage and an earlier part of the final stages.

In the case of Curve D, the value of the ratio of $PH_2O/PH_2$ is changed so as to exhibit two peaks in the initial stage, gradually lowered in a later part of the initial stage and an earlier part of the final stage, and, then, maintained at a low level at a later part of the final stage.

In the case of Curve E, the value of the ratio of $PH_2O/PH_2$ lowers at a constant rate over both the initial and final stage with the lapse of time of the decarburization annealing operation.

In Curve F, the value of the ratio of $PH_2O/PH_2$ very rapidly increases and, then, rapidly decreases in an earlier part of the initial stage so as to form a peak, as appears in FIG. 4, and slowly decreases in a later part of the initial stage. Thereafter, the ratio of $PH_2O/PH_2$ slowly decreases in an earlier part of the final stage, rapidly decreases in a middle part of the final stage and, then, slowly decreases in a later part of the final stage.

In Curve G, the value of the ratio of $PH_2O/PH_2$ very rapidly increases to a high level in an earlier part of the initial stage and, then, in a middle part of the initial stage, very rapidly decreases to a very low level so as to form a sharp peak, as illustrated in FIG. 4, and, also, very rapidly increases to a high level. In a later part of the initial stage, the value of the ratio of $PH_2O/PH_2$ gradually decreases so as to form a round peak, as illustrated in FIG. 4. Thereafter, the value of the ratio of $PH_2O/PH_2$ rapidly decreases, in an earlier part of the final stage, to a low level and, then, maintained in the low level in a later part of the final stage. As shown in FIG. 4, the lowest level of the ratio of $PH_2O/PH_2$ in the middle part of the initial stage is approximately the same as the level in the later part of the final stage. That is, the value of the ratio of $PH_2O/PH_2$ may be decreased temporarily to a level lower than 0.15 during the initial stage of the decarburization annealing operation, as long as the value reaches a level of 0.15 or more after the above-mentioned temporary decrease.

When the decarburization annealing operation is carried out in accordance with the process of the present invention in such a manner that coordinates of the values of the ratio of $PH_2O/PH_2$ in the initial and final stages are located within the area marked by slanted lines in FIG. 3, the resultant electrical steel sheet exhibits an excellent magnetic property and is also capable of forming a glass film firmly bonded thereto in a finishing annealing operation. The advantages mentioned above are shown in FIGS. 7 and 8.

Figure 7:
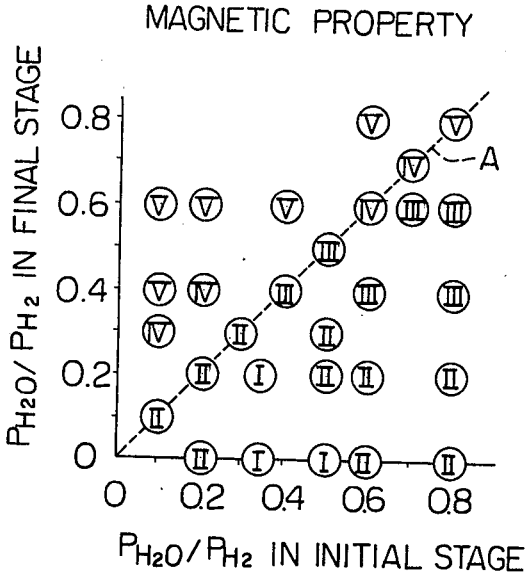
FIG. 7 is a diagram showing magnetic properties of grain oriented electrical silicon steel sheets produced in various ratios of $PH_2O/PH_2$ in the initial and final stages of the decarburization annealing operations.
Figure 8:
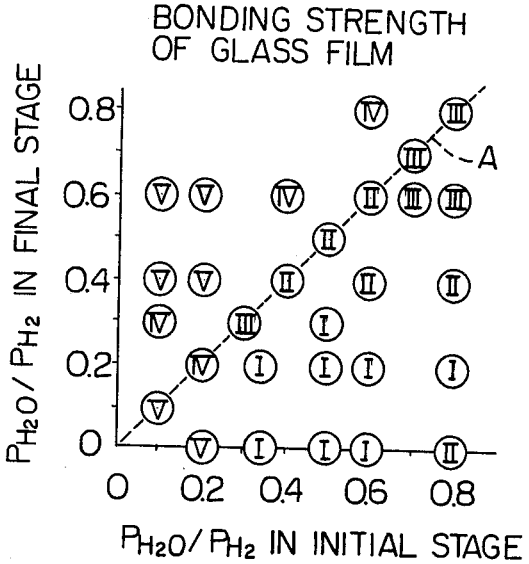
FIG. 8 is a diagram showing bonding strengths of glass film formed on grain oriented electrical silicon steel sheets produced in various ratios of $PH_2O/PH_2$ in the initial and final stages of the decarburization annealing operations.

FIGS. 7 and 8 show results of a number of experiments of Example 4 which will be set forth hereinafter. Each of the experiments has been carried out by decarburization annealing of a grain oriented silicon steel sheet at a temperature of 830° C. for 120 seconds. That is, in each of the initial (60 seconds) and final stage (60 seconds), the steel sheet was exposed to an oxidizing atmosphere in a predetermined value of the ratio of $PH_2O/PH_2$. The magnetic property of the resultant electrical steel sheet and the bonding strength of the glass film to the resultant electrical sheet are classified as follows.

| Class | I | II | III | IV | V |
|---|---|---|---|---|---|
| Magnetic property ($W_{17/50}$, Watt/kg) | <1.05 | 1.05-1.10 | 1.10-1.20 | 1.20-1.40> | 1.40 |
| Bonding strength of glass film (%) | <5 | 5-20 | 20-50 | 50-90> | 90 |

The method for determining the bonding strength of glass film will be described in Example 4 hereinafter.

FIGS. 7 and 8 show that the magnetic properties and bonding strengths of the electrical steel sheets which have been prepared in such a manner that the value of the ratio of $PH_2O/PH_2$ in the final stage is larger than that in the initial stage are inferior to those of the electrical steel sheets which have been prepared in such a manner that the value of the ratio of $PH_2O/PH_2$ in the final stage is the same as that in the initial stage. Also, FIGS. 7 and 8 show that the magnetic properties and bonding strengths of the electrical steel sheets which have been prepared in such a manner that the value of the ratio of $PH_2O/PH_2$ in the final stage is smaller than that in the initial stage, are superior to those of the electrical steel sheets which have been prepared in such a manner that the value of the ratio of $PH_2O/PH_2$ in the final stage is the same as that in the initial stage.

The reason why the bonding strength is increased by the process of the present invention has not yet been clearly clarified. However, the reason is assumed as follows.

The bonding strength of the glass film to the electrical silicon steel sheet depends on the thickness and the internal structure and composition of the glass film. The thickness and the internal structure and composition of the glass film is closely related to the thickness and the internal structure and composition of an internal oxidized layer which has been formed in the surface portion of the electrical steel sheet by the decarburization annealing operation in a weak oxidation atmosphere. For example, when the decarburization annealing operation is carried out in a ratio of $PH_2O/PH_2$ of 0.1 in both the initial and final stages, the resultant internal oxidized layer of the electrical steel sheet has a relatively small thickness of from 1 to 2 microns. Accordingly, when the electrical steel sheet is finish-annealed, the resultant glass film formed on the sheet has a small thickness. This thin glass film exhibits a poor bonding strength to the steel sheet.

Also, when the decarburization annealing operation is carried out in a relatively large ratio of $PH_2O/PH_2$ of 0.4 or 0.6, in both the initial and final stages, the resultant internal oxidized layer has a thickness of from 5 to 7 microns. This thick internal oxidized layer causes the glass film formed on the internal oxidized layer to exhibit a relatively large thickness and high bonding strength to the sheet.

In the process of the present invention, the decarburization annealing operation in its initial stage is carried out at a relatively large value of the ratio of $PH_2O/PH_2$ so as to form a relatively thick internal oxidized layer. Thereafter, in the final stage, the decarburization annealing operation is carried out at a relatively small value of the ratio of $PH_2O/PH_2$ so as to improve the internal structure and composition of the outermost surface portion of the internal oxidized layer. This improved internal structure and composition of the outermost surface portion of the internal oxidized layer results in the formation of a glass film having a preferable internal structure and composition and a high bonding strength to the steel sheet.

The mechanism of the improvement in the magnetic property of the electrical steel sheet by the process of the present invention is supposed as follows.

It is assumed that the magnetic property of the electrical steel sheet closely relates to the thickness and the internal structure and composition of the internal oxidized layer, especially, to the properties and thickness of the outermost surface portion thereof. In the case of the decarburization annealing operation in which the value of the ratio of $PH_2O/PH_2$ in the initial stage is the same as that in the final stage so that all the coordinates of the values of the ratio of $PH_2O/PH_2$ are located in a line A in FIG. 7, the smaller the value of the ratio of $PH_2O/PH_2$, the more superior the magnetic property of the resultant electric steel sheet. That is, the small value of the ratio of $PH_2O/PH_2$ results in the formation of a thin internal oxidized layer which has an internal structure and composition suitable for improving the magnetic property of the electrical steel sheet.

In the process of the present invention, a relatively thick internal oxide layer is formed in the initial stage of the decarburization annealing operation, and, then, the outermost surface portion of the internal oxidized layer is modified in the final stage of the decarburization annealing operation so that the modified outermost surface portion contributes to improving the magnetic property of the electrical steel sheet.

However, when the decarburization annealing operation in its final stage is carried out in a larger value of the ratio of $PH_2O/PH_2$ than that in the initial stage, the outermost surface portion of the internal oxidized layer is undesirably modified so as to deteriorate the magnetic property of the electrical steel sheet.

It should be noted that in the conventional decarburization annealing operation wherein the value of the ratio of $PH_2O/PH_2$ in the initial stage is the same as that in the final stage, sometimes, it may happen that a change in operational conditions of the annealing furnace causes the value of the ratio of $PH_2O/PH_2$ in the final stage to be increased to a higher level than that in the initial stage. This undesirable increase in the value of the ratio of $PH_2O/PH_2$ in the final stage will cause the magnetic property of the resultant electrical steel sheet to be deteriorated. However, in the process of the present invention, since the value of the ratio of $PH_2O/PH_2$ in the final stage of the decarburization annealing operation is maintained in a lower level than that in the initial stage, it is possible to carry out the decarburization annealing operation in a stable condition without deterioration in magnetic property of the electrical steel sheet. The decarburization annealing operation in the process of the present invention exhibits a higher decarburizing rate for the steel sheet than that in the conventional decarburization annealing operation, when the value of the ratio of $PH_2O/PH_2$ in the final stage is 0.15 or more. In the conventional decarburization annealing operation, the decarburizing rate of the outermost surface portion of the internal oxidized layer is reduced with the lapse of time of the decarburization annealing operation and, finally, regulated by the so-called interfacial rate control. However, in the process of the present invention, the decarburizing rate is not regulated by the so-called interfacial rate control even in the final stage of the decarburization annealing operation, because the outermost surface portion of the internal oxidized layer does not hinder the decarburization.

The above-mentioned phenomenon will be illustrated by way of Example 1 hereinafter.

As stated hereinbefore, the properties of the glass film formed on the steel sheet in the finishing annealing operation are closely related to the thickness of the internal oxidized layer, and the internal structure and composition of the outermost surface portion of the internal oxidized layer. In the process of the present invention, the decarburization annealing operation in its initial stage is carried out for a short time in such a large ratio of $PH_2O/PH_2$ that the conventional decarburization annealing operation will result in excessive oxidation of the surface portion of the steel sheet, and the excessively oxidized surface layer will obstruct the decarburization, so as to form an internal oxidized layer having a relatively large thickness which is effective for improving the capability of firmly bonding the glass film to the steel sheet. Thereafter, in the final stage of the decarburization annealing operation, in which the ratio of $PH_2O/PH_2$ is relatively small, the outermost surface portion of the internal oxidized layer is modified so as to improve the bonding property of the glass film and the magnetic property of steel sheet. That is, in the process of the present invention, since the relatively thick internal oxidized layer can be formed in a short time in the initial stage, the steel sheet can be passed through the decarburization annealing operation at a relatively high speed. This phenomenon will be illustrated in detail by way of Example 1 hereinafter.

The decarburization annealing operation in the process of the present invention is effective for forming very stable secondary recrystallized grains and, also, for easily producing a grain oriented steel sheet which exhibits an extremely small watt loss, not only in the case where the steel sheet has a relatively large thickness of from 0.275 to 0.35 mm but, also, in the case where the steel sheet has a relatively small thickness of 0.225 mm. This phenomenon will be illustrated by means of Example 4 hereinafter. It is assumed that the above-mentioned advantage of the process of the present invention is based on the fact that the stability in the growing of the secondary recrystallized grains closely depends on the property and condition of the outermost surface portion of the internal oxidized layer. The smaller the thickness of the steel sheet, the closer the above-mentioned dependency. The decarburization annealing operation in the process of the present invention is very effective for modifying the property and conditions of the outermost surface portion so as to stabilize the growing of the secondary recrystallized grains.

The decarburization annealing operation of the process of the present invention may be carried out at a constant temperature throughout the entire period of the operation. However, the present invention is not limited to the above-mentioned type of heating. The decarburization annealing temperature in the initial stage may be different from that in the final stage. In each of the initial and final stages, the annealing temperature may be changed in one step or more.

Moreover, the decarburization annealing operation of the process of the present invention may be carried out in such a manner that, after the initial stage of the operation is carried out at an elevated temperature, the steel sheet is cooled to room temperature, and then, heated to a desired elevated temperature in the final stage of the operation. This type of the decarburization annealing operation is illustrated in Example 4 set forth hereinafter.

In general, in the final stage, when the value of the ratio of $PH_2O/PH_2$ is larger than 0.75 or less than 0.15, the decarburization proceeds at a very small rate. However, this is sometimes effective for attaining the aforementioned objects of the present invention.

The decarburization annealing operation of the process of the present invention may be carried out in such a manner that the temperature is controlled within a range of from 750° to 880° C. throughout the entire period of the operation, the ratio of $PH_2O/PH_2$ in the oxidation atmosphere in the initial stage of the operation is adjusted to a value of 0.15 or more and, then, the ratio of $PH_2O/PH_2$ in the oxidation atmosphere in the final stage is adjusted to a value of from 0.15 to 0.75 and smaller than that in the initial stage. In this manner, the annealing temperature ranging from 750° to 880° C. is suitable for carrying out the decarburization annealing at a proper diffusion velocity of carbon in the steel sheet, while preventing the undesirable formation of an excessively oxidized layer in the surface portion of the steel sheet. The value of the ratio of $PH_2O/PH_2$ of 0.15 or more in the initial stage is effective for smoothly carrying out the decarburization in a short time. Also, the above-specified value of the ratio of $PH_2O/PH_2$ in the final stage is important for producing an electric steel sheet having the proper magnetic properties.

Figure 5:
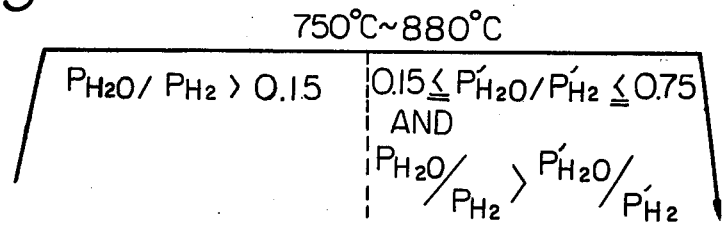
FIG. 5 is an explanatory diagram of a preferable example of the decarburization annealing operation in accordance with the process of the present invention.

The above-mentioned type of decarburization annealing operation is represented graphically in FIG. 5.

The values of the ratio of $PH_2O/PH_2$ in the initial and final stages are variable, depending on the proportion of the period of the initial stage to that of the final stages. Usually, it is preferable that the proportion of the period of the final stage to the entire period of the decarburization annealing operation is in a range of from 1/10 to 9/10. For example, when the proportion of the period of the final stage to the entire period of the operation is in a range of from 1/5 to $\frac{2}{3}$, the effect of the process of the present invention can be enhanced by adjusting the ratio of $PH_2O/PH_2$ in the initial stage to a value of from 0.30 to 0.75 and by adjusting that in the final stage to a value of from 1.15 to 0.30. The effect of the above-adjusted values of the ratio of $PH_2O/PH_2$ is illustrated in Example 2 set forth hereinafter. The above-mentioned type of the decarburization annealing operation, in which the decarburization is carried out throughout the entire period of the operation, is effective for enhancing not only the magnetic properties of the electrical steel sheet and the stability of the growing of the secondary recrystallized grains but, also, the productivity of the electrical steel sheet.

Figure 6:
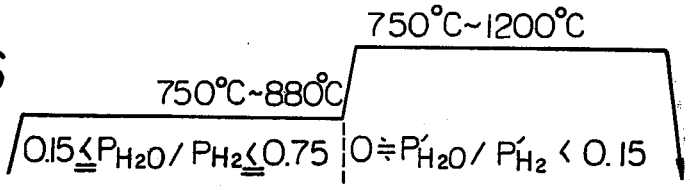
FIG. 6 is an explanatory diagram of another example of the decarburization annealing operation in accordance with the process of the present invention.

The decarburization annealing operation of the process of the present invention may be carried out in such another manner that the initial stage of the operation is carried out at a temperature of from 750° to 880° C., at a ratio of $PH_2O/PH_2$ of from 0.15 to 0.75, in the oxidation atmosphere, so that the decarburization smoothly proceeds and, then, the final stage of the operation is effected at a temperature of from 750° to 1200° C., at a ratio of $PH_2O/PH_2$ of from a value very near zero to another value smaller than 0.15, in the oxidation atmosphere. This type of the decarburization annealing operation is represented graphically in FIG. 6. In this type of operation, the decarburization is substantially completed in the initial stage of the operation. Thereafter, in the final stage, the decarburized steel sheet is treated in a very weak oxidation atmosphere, so as to improve the magnetic property of the steel sheet and the capability of firmly bonding of the glass film to the steel sheet. This improvement is realized by modifying the properties and condition of the outermost surface portion of the internal oxidized layer. This modification can be effectively carried out at a high temperature of from 750° to 1200° C. The effect of this type of decarburization annealing operation is illustrated in Example 4 set forth hereinafter. This operation is very effective for improving the magnetic property of the steel sheet and the capability of firmly bonding the glass film to the steel sheet, especially in the case of a thin steel sheet, rather than for enhancing the productivity of the steel sheet.

The following examples are intended to illustrate the application of the process of the present invention, but are not intended to limit the scope of the present invention.

EXAMPLES 1, 2 AND 3, AND COMPARATIVE EXAMPLES 1 AND 2

In Example 1, a hot rolled steel sheet containing 3.25% of silicon, 0.032% of Carbon, 0.057% of manganese and 0.016% of sulphur and having a thickness of 2.5 mm was pickled and, then, cold rolled to reduce the thickness thereof to 0.65 mm. The cold rolled steel sheet was heated to a temperature of 870° C., in a stream of hydrogen gas, for 3 minutes and, then, cold rolled to reduce the thickness thereof to a desired value of 0.35 mm. The thus obtained steel sheet was subjected to a decarburization annealing operation, in an atmosphere containing a mixture of 90% of hydrogen and 10% of nitrogen. The ratio of $PH_2O/PH_2$ in the initial stage of the operation was adjusted to a value of 0.37, which corresponded to a dew point of 65° C., by passing the mixed gas through water. In the final stage of the operation, the ratio of $PH_2O/PH_2$ was adjusted to a value of 0.15, which corresponded to a dew point of 50° C. The ratios of $PH_2O/PH_2$ in the initial and final stages are indicated by a coordinate b in FIG. 3. The initial stage of the operation was carried out at a temperature of 800° C., for 100 seconds and, then, the final stage of the operation was conducted at a temperature of 50° C., for 50 seconds.

The resultant decarburization annealed steel sheet was coated with magnesium oxide and subjected to a finish annealing operation in a dry hydrogen gas stream, at a temperature of 1150° C., for 10 hours. The resultant electrical steel sheet was composed of secondary recrystallized grains oriented in two directions of (110) and (001). The electrical steel sheet was subjected to a test for determining the magnetic properties of $B_{10}(w_b/m^2)$ and $W_{17/50}$ (watt/kg). Also, the bonding strength of the glass film to the steel sheet was measured in such a manner that the sheet was wound around one half of the peripheral surface of a rod having a diameter of 25 mm, so as to cause the glass film formed on the surface of the sheet to be peeled from the surface of the sheet. A proportion in percent of the area of a portion of the glass film which had been peeled off from the surface of the sheet to the entire area of the glass film was measured. The bonding strength was represented by the above-measured proportion. Furthermore, the content of carbon in the electrical steel sheet was determined.

The results of Example 1 are shown in Table 1.

In Comparative Example 1, the same procedures as those described in Example 1 were carried out, except that throughout the entire period of 150 seconds of the decarburization annealing operation, the ratio of $PH_2O/PH_2$ was maintained at a level of 0.37, which corresponded to a dew point of 65° C. and the temperature of the atmosphere was kept at 850° C. The above-mentioned value of the ratio of $PH_2O/PH_2$ is represented by a coordinate a in FIG. 3.

In Comparative Example 2, the same procedures as those described in Example 1 were carried out, except that through-out the entire period of 170 seconds of the decarburization annealing operation, the ratio of $PH_2O/PH_2$ was maintained at a level of 1.0, which corresponded to a dew point of 80° C. of the atmosphere, and the temperature was kept at 810° C. The value of $PH_2O/PH_2$ is represented by a coordinate c in FIG. 3.

In Example 2, the same procedures as those described in Example 1 were carried out, except that the atmosphere was maintained at a temperature of 810° C. over the entire period of 170 seconds of the decarburization annealing operation, at a ratio of $PH_2O/PH_2$ of 1.0, which corresponded to a dew point of 80° C., in the initial stage for 60 seconds, at a ratio of $PH_2O/PH_2$ of 0.20, which corresponded to a dew point of 54° C., in an earlier part of the final stage for 70 seconds. In a later part of the final stage of 40 seconds, the dew point of the atmosphere was adjusted to −40° C., which corresponded to a ratio of $pH_2O/pH_2$ very close to zero. The values of the ratio of $PH_2O/PH_2$ in the initial stage and the earlier part of the final stage are indicated by a coordinate d in FIG. 3. Also, the value of the ratio of $PH_2O/PH_2$ in the later part of the final stage are represented by a coordinate e in FIG. 3.

In Example 3, procedures identical to those described in Example 2 were carried out, except that the atmosphere in the later part of the final stage was heated to a temperature of 878° C., while maintaining the dew point of the atmosphere at a level of −40° C.

The results of Examples 2 and 3 and Comparative Examples 1 and 2 are shown in Table 1.

TABLE 1

| Example No. | Carbon content after decarburization annealing | Magnetic property $B_{10}$(Wb/m$^2$) | Magnetic property $W_{17/50}$(Watt/Kg) | Bonding strength of glass film to steel sheet (%) |
|---|---|---|---|---|
| Comparative Example 1 (Prior art) | 0.0017 | 1.83-1.85 | 1.35-1.45 | 50-70 |
| Example 1 (The present invention) | 0.0011 | 1.84-1.86 | 1.28-1.36 | 0-20 |
| Comparative Example 2 (Prior art) | 0.0152 | 1.79-1.82 | 1.43-1.65 | 40-70 |
| Example 2 (The present invention) | 0.0009 | 1.84-1.86 | 1.27-1.36 | 0-10 |
| Example 3 (The present invention) | 0.0010 | 1.85-1.87 | 1.27-1.34 | 0-5 |

It will be noted from Table 1, that the product of Comparative Example 2 had a very high content of carbon. That is, the decarburization annealing operation in Comparative Example 2 is only slightly effective for decarburization, because the dew point of the atmosphere was very high, in other words, the ratio of $PH_2O/PH_2$ was very large.

In each of Examples 1 through 3 and Comparative Example 1, the steel plate was decarburized to such a level that the resultant decarburized steel sheet exhibited no disadvantage in the aging property thereof. However, if the carbon content of the product of Example 1 is compared with that of Comparative Example 1, it is evident that the decarburization annealing operation of Example 1 was more effective for the decarburization than that of Comparative Example 1.

Also, Table 1 clearly shows that the products of Examples 1, 2 and 3, carried out in accordance with the process of the present invention, are superior in magnetic property and bonding strength to those of Comparative Examples 1 and 2, carried out in accordance with a prior art.

EXAMPLE 4

Twenty nine pieces of a mono-directional hot rolled steel sheet, which had a thickness of 2.5 mm and consisted of 2.95% of silicon, 0.053% of carbon, 0.082% of manganese, 0.028% of sulphur, 0.029% of aluminium, 0.0075% of nitrogen and the balance consisting essentially of iron, were annealed at a temperature of 1135° C., pickled and, then, cold rolled to reduce the thickness thereof to a level of 0.30 mm. Each of eight pieces of the cold rolled sheet was subjected to a conventional decarburization annealing operation, at a temperature of 830° C., at a predetermined ratio of $PH_2O/PH_2$ of from 0.1 to 0.8, for the entire period of the operation of about 120 seconds.

Each of 14 pieces of the cold rolled sheet was subjected to a decarburization annealing operation of the process of the present invention in which, in the initial stage thereof, the atmosphere was maintained at a temperature of 830° C., at a predetermined ratio of $PH_2O/PH_2$ of 0.15 or more, for 60 seconds, and then, in the final stage thereof, the atmosphere was maintained at a temperature of 830° C., at a predetermined ratio of $PH_2O/PH_2$ of smaller than that in the initial stage, for 60 seconds.

Each of seven pieces of the cold rolled sheet was subjected to another decarburization annealing operation in which, in the initial stage thereof, the atmosphere was maintained at a temperature of 830° C., at a ratio of $PH_2O/PH_2$ of from 0.1 to 0.6, for 60 seconds, and then, in the final stage thereof, the atmosphere was maintained at a temperature of 830° C., at a ratio of $PH_2O/PH_2$ of larger than that in the initial stage.

In the above-mentioned operations, the value of the smallest ratio of $PH_2O/PH_2$ close to zero corresponded to a dew point of −60° C. of the atmosphere. Also, the largest ratio of $PH_2O/PH_2$ of 0.9 corresponded to a dew point of 80° C. of the atmosphere. With regard to the products of the above-mentioned operations, the contents of remaining carbon were determined by means of a chemical analysis. It was found that only when the decarburization annealing operation was carried out at a ratio of $PH_2O/PH_2$ of from 0.15 to 0.75, the content of carbon was reduced to a level of 0.0025% or less.

Each of the decarburized, annealed steel pieces was coated with magnesium oxide and, then, finish-annealed in a dry hydrogen gas stream at a temperature of 1200° C. for 20 hours. Thereafter, the piece was coated with a liquid composition consisting of 100 ml of a 20% aqueous dispersion of colloidal silica, 60 ml of a 50% aqueous solution of aluminium phosphate, 6 grams of chromic anhydride and 2 grams of boric acid, in accordance with the method described in Japanese Laid-open Patent Application No. 48-39338(1973), and then, cured at a temperature of 800° C. The coated piece was subjected to a measurement of the magnetic property thereof. Also, the bonding property of the coating film to the steel sheet was determined in the following manner. The coated piece was bent around one half of a peripheral surface of a rod having a diameter of 15 mm and, then, flattened. After that, the area of a portion of the coating film peeled off from the sheet was determined and, then, the proportion of the area of the peeled off portion of the coating film to the entire area of the coating film was determined. The bonding property of the coating film to the steel sheet was represented by the above-determined proportion in percent.

The resultant values of the magnetic character and the bonding property of the products were classified in the manner indicated hereinbefore.

In FIG. 7, the class of the magnetic character of each product is indicated in a coordinate of the ratio of $PH_2O/PH_2$ at which the product was decarburization-annealed.

In the case of the conventional decarburization annealing operation in which the atmosphere was maintained at a constant value of the ratio of $PH_2O/PH_2$ throughout the entire period of the operation, the coordinate of each ratio of $PH_2O/PH_2$ falls in a straight line A drawn at an angle of 45 degrees from the axis of abscissa in FIG. 7. Accordingly, the magnetic property, in terms of class, of product of the conventional decarburization annealing operation is indicated on the straight line A in FIG. 7. Also, in FIG. 7, the coordinate of each ratio of $PH_2O/PH_2$ in the decarburization annealing operation of the process of the present is located below the straight line A. Furthermore, in FIG. 7, the coordinate of each ratio of $PH_2O/PH_2$ in another decarburization annealing operation is located above the straight line A. Accordingly, the magnetic property, in terms of class, of each product of the decarburization annealing operation of the present invention is indicated in the corresponding coordinate of the ratio of $PH_2O/PH_2$, below the straight line A of FIG. 7. In the case of another decarburization annealing operation, the magnetic character in terms of class of each product is indicated in the corresponding coordinate of the ratio of $PH_2O/PH_2$, above the straight line A in FIG. 7.

In FIG. 8, the bonding property of each coating film to the steel sheet is illustrated, in terms of class, in the same manners as that in FIG. 7.

FIG. 7 shows that the products of the process of the present invention exhibit a relatively superior magnetic property. Also, FIG. 8 illustrates that in the products of the process of the present invention, the coating films exhibit a relatively high level of bonding property.

EXAMPLES 5 AND 6, AND COMPARATIVE EXAMPLE 3 AND 4

In Example 5, a hot rolled steel sheet, having a thickness of 3 mm and containing 0.046% of carbon, 3.05% of silicon, 0.073% of antimony and 0.045% of selenium, was pickled, cold rolled in the same direction as that in the previous hot rolling, at a reduction rate of 68%, and then, cold rolled at a right angle to the direction of the previous cold rolling, at a reduction of 64%, so as to provide a cold rolled steel sheet having a desired thickness of 0.35 mm. The steel sheet was subjected to a decarburization annealing operation at a temperature of 860° C., for 200 seconds, in a stream of a mixture of 50% of hydrogen and 50% of nitrogen, in such a manner that the ratio of $PH_2O/PH_2$ of the atmosphere was adjusted to a value of 0.35, which corresponded to a dew point of 56° C., in the initial stage of the operation of 150 seconds, and then, to a value of 0.18, which corresponded to a dew point of 44° C., in the final stage of the operation of 50 seconds.

The decarburized, annealed steel sheet was finish-annealed at a temperature of 1180° C., for 15 hours, in a dry hydrogen gas stream. The resultant electrical steel sheet was subjected to measurements of magnetic flux densities in the direction of the final cold rolling and in the direction at a right angle to the direction of the final cold rolling. The results of Example 5 are shown in Table 2.

In Example 6, procedures identical to those mentioned in Example 5 were carried out, except that the ratio of $PH_2O/PH_2$ in the initial stage of the decarburization annealing operation was adjusted to 0.55, which corresponded to a dew point of 66° C.

In Comparative Example 3, procedures identical to those described in Example 5 were carried out, except that the atmosphere was maintained at a ratio of $PH_2O/PH_2$ of 0.35 over the entire period of the operation.

In Comparative Example 4, the same procedures as those described in Comparative Example 3 were carried out, except that the ratio of $PH_2O/PH_2$ was 0.55.

The results of Example 6 and Comparative Examples 3 and 4 are shown in Table 2.

TABLE 2

| Example No. | Magnetic flux density B8 in direction of final rolling ($W^b/m^2$) | Magnetic flux density B8 at a right angle to final rolling direction ($W^b/m^2$) |
|---|---|---|
| Comparative Example 3 | 1.90–1.92 | 1.88–1.90 |
| Example 5 | 1.91–1.94 | 1.89–1.93 |
| Comparative Example 4 | 1.88–1.91 | 1.87–1.89 |
| Example 6 | 1.91–1.93 | 1.89–1.92 |

Table 2 shows that the magnetic property of the products of Examples 5 and 6 is superior to that of the products of Comparative Examples 3 and 4.

EXAMPLES 7 THROUGH 11 AND COMPARATIVE EXAMPLE 5

In Example 7, a hot rolled steel sheet having a thickness of 2.1 mm, and containing 3.05% of silicon, 0.041% of carbon, 0.105% of manganese, 0.028% of sulphur, 0.031% of aluminium and 0.0084% of nitrogen, was pickled and, then, cold rolled, so as to provide a sheet having a thickness of 0.225 mm. The resultant cold rolled steel sheet was subjected to a decarburization annealing operation in a stream of a mixture gas of 30% of hydrogen and 70% of nitrogen, at a temperature of 840° C., for 120 seconds, in such a manner that the atmosphere was maintained at a ratio of $PH_2O/PH_2$ of 0.35, which corresponded to a dew point of 45° C., in the initial stage of 80 seconds of the operation, and then, at a ratio of $PH_2O/PH_2$ of 0.20, which corresponded to a dew point of 35° C., in the final stage of 40 seconds.

The decarburized, annealed steel sheet was finish-annealed at a temperature of 1180° C., in a dry hydrogen gas stream, for 20 hours. The finish-annealed steel sheet was coated with the same liquid composition as that described in Example 4, in accordance with the method described in Japanese Laid-open Patent Application No. 48-39338(1973).

The coated steel sheet was subjected to measurements of magnetic property (B8 ($w^b/m^2$) and $W_{17/50}$ (watt/kg)). Also, the coated steel sheet was subjected to a measurement of the percent of formation of secondary recrystallized grains. In this measurement, the steel sheet was separated from the coating film and a proportion in percent of the secondary recrystallized grains formed in the steel sheet to the entire amount of crystalline grains was determined.

In Comparative Example 5, procedures identical to those mentioned in Example 7 were carried out, except that the atmosphere was maintained at a ratio of $PH_2O/PH_2$ of 0.35, which corresponded to a dew point of 45° C., at a temperature of 840° C. throughout the entire period of 120 seconds of the decarburization annealing operation.

In Example 8, the same procedures as those described in Example 7 were carried out, except that, in the final stage of 40 seconds, the ratio of $PH_2O/PH_2$ was adjusted to a value very close to zero, which corresponded to a dew point of −40° C.

In Example 9, the same procedures as those described in Example 8 were carried out, except that the temperature of the atmosphere in the final stage of the operation was adjusted to 870° C.

In Example 10, the same procedures as those described in Example 7 were carried out, except that after the initial stage of the operation was completed, the steel sheet was removed from the decarburization annealing atmosphere and cooled to room temperature, and then, placed into another decarburization annealing atmosphere having a temperature of 870° C. and a ratio of $PH_2O/PH_2$ very close to zero, which corresponds to a dew point of −40° C., and kept in this atmosphere for 40 seconds.

In Example 11, the same procedures as those described in Example 9 were carried out, except that the temperature of the decarburization annealing atmosphere in the final stage of the operation was adjusted to 950° C.

The results of Examples 7 through 11 and Comparative Example 5 are shown in Table 3.

TABLE 3

| Example No. | Magnetic character B8 (wb/m²) | Magnetic character $W_{17/50}$(watt/kg) | Percent of formation of secondary recrystallized grains (%) |
|---|---|---|---|
| Comparative | | | |

TABLE 3-continued

| Example No. | Magnetic character B8 (wb/m²) | Magnetic character $W_{17/50}$(watt/kg) | Percent of formation of secondary recrystallized grains (%) |
|---|---|---|---|
| Example 5 | 1.57-1.71 | 1.38-1.61 | 0-25 |
| Example 7 | 1.88-1.91 | 1.21-1.35 | 70-90 |
| Example 8 | 1.89-1.94 | 0.87-1.08 | 100 |
| Example 9 | 1.92-1.95 | 0.85-0.97 | 100 |
| Example 10 | 1.92-1.96 | 0.84-0.97 | 100 |
| Example 11 | 1.93-1.96 | 0.82-1.02 | 95-100 |

In each of the Examples 6 through 11, in spite of the fact that the steel sheet had a very small thickness of 0.225 mm, it was observed that the secondary recrystallized grains were stably grown and the resultant electric steel sheet exhibited excellent magnetic property. However, in Comparative Example 5, it was observed that the small thickness of the steel sheet caused the formation of the secondary recrystallized grains to be remarkably poor.

Especially, the decarburization annealing operations of Examples 9, 10 and 11, wherein the final stage of the decarburization annealing operation was carried out at a higher temperature than that in the initial stage and/or at a very small ratio of $PH_2O/PH_2 \div O$, were remarkably effective for enhancing the formation of the secondary recrystallized grains in the steel sheet having a small thickness.

The above-mentioned Examples 1 through 11 clearly illustrate the excellent effect of the process of the present invention.

In the process of the present invention, it is important that the initial stage of the decarburization annealing operation be carried out, for a relatively short time, in an oxidation atmosphere having such a large ratio of $PH_2O/PH_2$ that the decarburization by the conventional process will be obstructed by a thick oxidized layer formed in the steel sheet due to the large ratio of $PH_2O/PH_2$, and; then, the final stage of the operation is carried out at a ratio of $PH_2O/PH_2$ smaller than that in the initial stage. The process of the present invention is effective for producing a grain oriented electrical silicon steel sheet having excellent magnetic properties and a superior bonding property to the glass film or coating film. Also, the process of the present invention exhibits an enhanced capability of decarburizing the steel sheet.

The process of the present invention may be carried out in an annealing furnace in which a portion for the initial stage of the decarburization annealing operation is partitioned from another portion for the final stage of the operation. Otherwise, the process of the present invention can be carried out by using one furnace for the initial stage of the decarburization annealing operation and another separate furnace for the final stage of the operation. Moreover, the final stage of the decarburization annealing operation in accordance with the process of the present invention may be carried out after the steel sheet is coated with magnesium oxide.

What we claim is:

1. A process for producing a grain oriented electrical silicon steel sheet comprising: subjecting a cold-rolled silicon steel sheet, after it has been cold-rolled, to a continuous two-stage decarburization annealing procedure in an oxidation atmosphere, in an initial stage of which procedure a ratio of $PH_2O/PH_2$, wherein $PH_2O$ represents the partial pressure of water vapor in said oxidation atmosphere and $PH_2$ represents the partial pressure of hydrogen in said oxidation atmosphere, is adjusted to a value of 0.15 or more, and a decarburization annealing temperature is adjusted to a value of from 750° through 880° C. and; in a final stage of said procedure the ratio of $PH_2O/PH_2$ is adjusted to a value smaller than that in said initial stage, and said decarburization annealing temperature is adjusted to a value of from 750° through 1200° C., the total decarburization annealing time for both stages being 200 seconds or less.

2. A process as claimed in claim 1, wherein said ratio of $PH_2O/PH_2$ in said final stage of said decarburization annealing operation has a value of 0.75 or less.

3. A process as claimed in claim 1, wherein the proportion of the period of said final stage of said decarburization annealing operation to the entire period of said decarburization annealing operation is in a range of from 1/10 to 9/10.

4. A process as claimed in claim 1 or 2, wherein said ratio $PH_2O/PH_2$ in said final stage of said decarburization annealing operation is in a range of from 0.15 to 0.75.

5. A process as in claim 1 wherein the total decarburization annealing time for the two stages ranges from 120 to 200 seconds.

6. A process as claimed in claim 1, wherein said ratio of $PH_2O/PH_2$ is in a range of from 0.15 through 0.75 in the initial stage and less than 0.15 in the final stage.

* * * * *